United States Patent [19]

Uy

[11] Patent Number: 4,972,028

[45] Date of Patent: Nov. 20, 1990

[54] FIBRIDS FROM INTRACTABLE AND THERMOPLASTIC POLYMER COMBINATIONS

[75] Inventor: William C. Uy, Wilmington, Del.

[73] Assignee: E. I. Du Pont de Nemours and Company, Wilmington, Del.

[21] Appl. No.: 315,654

[22] Filed: Feb. 27, 1989

Related U.S. Application Data

[63] Continuation-in-part of Ser. No. 91,001, Sep. 2, 1987, Pat. No. 4,810,735, and a continuation-in-part of Ser. No. 33,259, Apr. 2, 1987, abandoned, and a continuation-in-part of Ser. No. 919,028, Oct. 15, 1986, abandoned.

[51] Int. Cl.[5] ..... C08L 79/04; C08L 81/00; C08L 77//06

[52] U.S. Cl. ..... 525/432; 525/434; 525/435

[58] Field of Search ..... 525/432, 434, 435

[56] References Cited

U.S. PATENT DOCUMENTS

| | | | |
|---|---|---|---|
| 2,999,788 | 9/1961 | Morgan | 162/46 |
| 4,018,735 | 4/1977 | Nakagawa | 524/157 |
| 4,207,407 | 6/1980 | Helminiak | 525/425 |
| 4,225,700 | 9/1980 | Wolfe | 528/337 |
| 4,228,218 | 10/1980 | Takayanagi | 525/58 |
| 4,631,318 | 12/1986 | Hwang | 525/432 |
| 4,640,948 | 2/1987 | Rasoul | 524/157 |

FOREIGN PATENT DOCUMENTS

| | | |
|---|---|---|
| 61-28015 | 2/1986 | Japan . |
| 2195672 | 4/1988 | United Kingdom . |

OTHER PUBLICATIONS

ACS, Div. of Org. Coatings etc. 48,929(1982), p. 929.
Polymer Eng. & Science, Mid-Oct. 1983, vol. 23, No. 14, pp. 784–788.
J. Macromol Sci.-Phys. B22(2), 231–257 (1983).

*Primary Examiner*—C. Warren Ivy

[57] ABSTRACT

Fibrids of poly-p-phenylenebenzobisthiazole, poly-p-phenylenebenzobisoxazole, or poly-2,5-benzoxazole and thermoplastic polymers in certain mixed solvents are provided.

7 Claims, No Drawings

FIBRIDS FROM INTRACTABLE AND THERMOPLASTIC POLYMER COMBINATIONS

RELATED APPLICATIONS

This application is a continuation-in-part of my applications Ser. No. 07/091,001, filed Sept. 2, 1987, now U.S. Pat. No. 4,810,735; Ser. No. 033,259, filed Apr. 2, 1987, now abandoned and Ser. No. 919,028, filed Oct. 15, 1986, now abandoned.

BACKGROUND

Poly-p-phenylenebenzobisthiazole, poly-p-phenylenebenzobisoxazole and poly-2,5-benzoxazole are intractable polymers by which is meant they are non-melting but soluble. Mixtures of these polymers have been made with thermoplastic polymers to provide melt-processability.

Fibrids of various polymers and their preparation are well known in the art (see Morgan, U.S. Pat. No. 2,999,788). The present invention provides a process for preparing fibrids from mixtures of the aforementioned intractable polymers and thermoplastic polymers, which are particularly suitable for production of papers and films thereof. The fibrids and the papers and films of such fibrids are new and possess unusual properties.

SUMMARY OF THE INVENTION

This invention provides fibrids comprising the polymer combination of an intractable polymer selected from poly-p-phenylenebenzobisthiazole, poly-p-phenylenebenzobisoxazole or poly-2,5-benzoxazole and a thermoplastic polymer in the proportions of 5% to 70% by weight of the intractable polymer and 30% to 95% by weight of the thermoplastic polymer as well as papers and films thereof and methods of making such products.

DETAILED DESCRIPTION OF THE INVENTION

Poly-p-phenylenebenzobisthiazole (PBT), poly-p-phenylenebisoxazole (PBO), and poly-2,5-benzooxazole (AB-PBO) are prepared in polyphosphoric acid (PPA) (see U.S. Pat. No. 4,533,693). Since they are highly intractable polymers, hence not amenable to melt-processing, efforts have been made to combine them with thermoplastic polyamides.

A novel spinnable quaternary dope and a technique for preparing it which is unobvious from and superior to the prior art procedures is the subject of my parent applications. It involves first preparing a solution of a thermoplastic polymer in methanesulfonic acid (MSA) or chlorosulfonic acid or an equivalent strong acid. Any of a variety of thermoplastic polymers may be used as the component which provides melt-processability. Thermoplastic polyamides are preferred. The concentration of the thermoplastic polymer in solution may range from about 0.5–20% on a weight basis, preferably 1–15%.

To the solution of the thermoplastic polymer, one adds a solution of PBT, PBO or AB-PBO in the polyphosphoric acid polymerization solvent and then shear mixes the combined solutions. Preferably the PBT, PBO or AB-PBO should have an intrinsic viscosity of at least 15 dL/g as measured in MSA. The concentration of the PBT, PBO or AB-PBO in the polyphosphoric acid should be at least 0.5 and preferably between 1 and 20 weight percent. The combined polymer concentration of the resulting quaternary solution should be at least 1% by weight and the MSA/PPA solvents ratio should range from 95/5 to 5/95 on a weight basis. In practice, chunks of the PBT, PBO or AB-PBO in polyphosphoric acid are added to the thermoplastic polymer solution with shear mixing, preferably without applying external heating to avoid degradation of less stable thermoplastic polymer. An Atlantic Mixer is quite useful for this purpose, shearing being effected by the wall wiping mechanism. The proportions of the solutions are selected to yield the ratio of PBT, PBO or AB-PBO to thermoplastic polymer desired in the dope. It is preferred that the concentrations of both solutions be about equal so that the final concentration of total polymer in the quaternary dope remains constant while the ratio of the two solutions are varied to obtain different polymer ratios. The ratio of PPA to MSA or chlorosulfonic acid is preferably in the range of 60:40 to 30:70 on a weight percent basis. To obtain maximum benefits, the PBT, PBO or AB-PBO should constitute from 5 to 70% by weight of the polymer mixture. The thermoplastic polymer should range from 30 to 95% by weight. Preferably, the polymers should be in the ratio of 60:40 to 40:60 by weight.

The quaternary solutions are particularly suitable for preparation of fibrids by shear precipitation of the dopes in a high speed blender (Waring). Small quantities of the dope are dropped into a blender containing ice water and subjected to high shearing action. The ice water controls temperature build-up and extracts the acid solvents of the dope. Fibrids of the polymer combination form as a result of the shear precipitation. The slurry is filtered through a sintered glass filter and the solids returned to the blender for further extraction of solvent by fresh ice water. Repetition of the process is continued until the acid solvent is substantially completely removed. The wet fibrids may then be dried.

It is then convenient to add a controlled amount of wet or dried fibrids and water to a blender to form the paper making slurry. This slurry is filtered through a screen or filter as a paper sheet which may be cold pressed for added strength. Finally, the pressed paper may be consolidated into a film under pressure and at elevated temperatures. The hot-pressing conditions employed in making will depend on the type and concentration of thermoplastic polymer in the fibrid as will be well understood by those in the art.

The following examples illustrate the invention and are not intended as limiting. Intrinsic viscosities were measured in MSA:

EXAMPLE 1

15 parts by weight of amorphous thermoplastic polyamide were added to 85 parts by weight of MSA in a glass jar and stirred at room temperature using a simple polytetrafluoroethylene coated magnetic stirred. The thermoplastic polyamide employed is an amorphous copolymer of (48tt) bis(p-aminocyclohexyl)methane, isophthalic and dodecanedioic acids in a 100/60/40 mol percent basis. The solution was a brown viscous liquid. 60.5 g of the solution was poured into an Atlantic Mixer (Model No. 2CV, Capacity: 150 cc). Then 61.8 grams of a 14.5 wt. % dope of PBT (19.6 dL/g intrinsic viscosity) in PPA were added to the mixture with the mixer operating at low speed and without applying external heating. The PBT/PPA dope broke up and "dissolved" into the polyamide-MSA solution. Mixing was continued into the next day, when the mixture became homogeneous. The resulting quaternary solution or dope exhibited shear opalescence. It was stirred and deaerated under vacuum overnight. The dope was transferred to a spin cell and spun at 54° C. through a 0.25 inch air gap into an ice water bath to extract solvent. The dope was spun from a 10-hole spinneret (0.004 in holes) at 7.5 m/min. The through-put rate was 0.02 ml/min/hole. To ensure complete removal of the acid solvents, bobbins of yarn were immersed in water overnight and then air dried. The as-spun composite yarn (PBT/polyamide, 50/50 by weight or 42/58 by volume) had the following filament tensile properties (denier, tenacity, elongation, modulus) (D/T/E/M): 66 denier, 4.3 gpd, 1.4%, 344 gpd, and an orientation angle of 15°. Thermal stability was evaluated by threading the yarn through a horizontal hot tube with one end tied and a 10-gram load on the other end. The temperature was raised to 716° C. over a period of 3 hours 30 minutes at which point the yarn broke.

EXAMPLE 2

15 grams of an amorphous thermoplastic polyamide, a copolymer of hexamethylene diamine, (20tt) bis(p-aminocyclohexyl)methane, isophthalic and terephthalic acids in a 96/4/70/30 mol percent basis, was dissolved in 85 grams of MSA at room temperature. 72.3 grams of the solution was mixed with 73.2 grams of the same PBT/PPA dope used in EXAMPLE 1 to give PBT/polyamide weight ratio of 50/50 and MSA/PPA solvents ratio of 50/50. The mixing was done without external heat. After several hours, a homogeneous quaternary spin dope was obtained. It was shear opalescent and light metallic green. Mixing was continued to the next day when vacuum was applied to deaerate the dope. After remaining quiescent over a weekend, some phase separation took place. The dope was mixed for 2.5 hours before transferring to the spin cell. It was spun at 60° C. from a 10-hole spinneret of 0.005 in hole diameter through a 0.75 in air gap at 7.5 m/min with spin-stretch factor of 4.7 into ice water.

A portion of the dope was removed before spinning and fed to a Waring blender containing ice water. About 5 g of dope was added to about 300 ml of water. The quaternary dope was converted to fibrids by the high shearing action of the blades while the solvents were extracted by the water. The resulting slurry was filtered and the solids returned to the blender with fresh ice water. The procedure was repeated until the pH of the aqueous medium indicated that the acids had been substantially removed.

The fibrids were allowed to dry in air. Papers were made by slurrying 0.5 g of the above air-dried fibrids in 300 to 500 ml water and quickly pouring the slurry into a 9-cm diameter Buchner funnel lined with a #40 filter paper. The wet paper, about 3 in. in diameter, was removed, sandwiched between two polyimide films ("Kapton", E. I. du Pont de Nemours and Company) and pressed at room temperature at 8000 pounds pressure. Film was formed from the paper by hot pressing at 315° C. for about 5 minutes at 100 pounds per square inch pressure. The film (2.94 ounces/sq.yd.) exhibited a breaking stress of 1.57 KPSI and a modulus of 202 KPSI. The test procedure employed was ASTM 828 Strip Tensile Test using a specimen width of 0.25 in.

EXAMPLE 3

A solution was made using 30 grams of the polyamide of EXAMPLE 1 and 170 grams of MSA. 94.2 grams of this solution were mixed with 141.3 grams of the same PBT/PPA dope used in the above examples to make a spin dope where the PBT/polyamide ratio was 60/40 by weight or 53/47 by volume and MSA/PPA ratio of 40/60. The homogeneous quaternary spin dope was heated to 60° C. to reduce viscosity for transfer to the spin cell. Yarn was spun at 75° C. through a 0.375 in air gap, at 7.5 m/min using 10-hole spinneret with 0.005 in holes. Spinning was excellent. After overnight immersion in water, the bobbin of yarn was immersed in acetone the next night to extract any residual MSA. The dried composite fiber T/E/M properties are 5.3 gpd/1.0%/342 gpd.

EXAMPLE 4

A spin dope of PBT and the polyamide of EXAMPLE 1 at a polymer ratio of 59.2/40.8 by weight (51/49 by volume) was made using 54.3 grams of the polyamide/MSA solution of EXAMPLE 3 and 81.4 grams to the same PBT/PPA dope used in the above examples. The resulting quaternary spin dope with a MSA/PPA ratio of 40/60 was mixed without external heating. On the following day, the temperature was raised to and kept at 75° C. for 1.5 hours to reduce viscosity before transfer to the spinning cell. Yarn was spun at 75° C., through a 0.5 in air gap, at 7.5 m/min using a 10-hole spinneret having 0.005 in holes.

A portion of the dope was removed before spinning and made into fibrids, paper and film as described in EXAMPLE 2. The film (3.41 oz/sq. yd.) exhibited a break stress of 1.86 KPSI and a modulus of 102 KPSI.

EXAMPLE 5

A quaternary spin dope containing cis-PBO and the polyamide of Example 1 in a 66/34 weight ratio (59/41 by volume) was made using 65.2 grams of 15% of the polyamide in MSA and 136.2 grams of 14.1% cis-PBO (intrinsic viscosity of 16.6 dL/g) in PPA. The mixture with a MSA/PPA ratio of 32/68 was mixed overnight under house vacuum (24 in vacuum) without applying external heat. The resulting quaternary dope was heated to 60° C. the next day to improve flowability for filling the spin cell. The dope was shear anisotropic. Yarn was spun at 60° C. through a 0.75 in air gap at 7.5 m/min using a 10-hole (0.005 in holes) spinneret. The composite fiber has the following T/E/M tensile properties: 8.4 gpd/2.2%/324 gpd. The fiber orientation angle is 17°.

A portion of the dope was removed before spinning and made into fibrids, paper and film as described in EXAMPLE 2. The film (3.39 oz/sq.yd.) exhibited a break stress of 0.44 KPSI and a modulus of 21 KPSI.

EXAMPLE 6

A quaternary spin dope containing AB-PBO from 3-amino-4-hydroxybenzoic acid and the polyamide of Example 1 in 66/34 weight (60/40 volume) ratio was made using 69.5 grams of the polyamide in MSA and 139.8 grams of AB-PBO (intrinsic viscosity of 8.8 dL/g) in PPA. The AB-PBO/PPA dope viscosity was high and it could not be mixed with the polyamide/MSA solution until it was heated up to 70° C. at which time a homogeneous dope was prepared. The dope was removed from the mixer and charged into the spin cell. Yarn was spun at 70° C. through a 0.7 in air gap, and at a throughput rate of 0.02 ml/min/hole but at a windup speed of 2.0 m/min. The dried composite fiber has T/E/M tensile properties of 2.3 gpd/12.5%/36 gpd. The fiber orientation angle is 45°.

A portion of the dope was removed before spinning and made into fibrids, paper and film as described in EXAMPLE 2. The film (3.76 oz/sq. yd) exhibited a break stress of 1.40 KPSI and a modulus of 85 KPSI.

EXAMPLE 7

A quaternary spin dope consisting of 3.0 weight percent solids (60 weight percent PBT/40 weight percent of the polyamide of Example 1, in 97 weight percent mixed solvents (50 weight percent MSA/50 weight percent PPA) was prepared from a solution of the polyamide of Example 1 at 1.35 weight percent concentration in MSA/PPA (55.9 weight percent MSA/44.1 weight percent PPA) and a dope of PBT (17.0 dL/g intrinsic viscosity) at 14.9 weight percent concentration of PPA. Preparation was as follows: 110.2 grams of MSA and 87.0 grams of PPA were mixed together in a glass jar at room temperature using a "Teflon" coated magnetic stirrer. 2.7 grams of the polyamide was added to the MSA/PPA mixed solvents and stirred at room temperature. The solution was poured into an Atlantic Mixer. Then 27.3 grams of the PBT/PPA dope were added to the Mixer while operating at slow speed under vacuum (for deaeration) without applying external heat. The PBT/PPA dope was found to gradually break up and "dissolve" into the polyamide MSA/PPA solution. The next day there were still a few chunks of PBT/PPA dope stuck at the top of the Mixer blades. The chunks of PBT/PPA dope were scraped into the rest of the spin dope, and mixing was continued into the next day when the mixture became a homogeneous phase, gel-like in consistency. The quaternary spin dope was transferred to a spin cell and air-gap spun (0.25 in air-gap) at room temperature at 12.6 meter/minute using a 10-hole spinneret with hole diameter of 0.005 in and a spin-stretch factor of 4.0 [a 10-hole spinneret with a hole diameter of 0.010 in was also used to air-gap spin (0.25 in air-gap) yarn at room temperature and 2.0, 4.0 and 6.0 meter/minute with a spin-stretch factor of 2.5, 5.0, and 7.6, respectively.]The throughput rate was 0.04 ml/min/hole. To ensure complete removal of the acid solvents, the bobbins of yarn were immersed in water (the extraction solvent) overnight and then air dried. The as-spun yarn (PPB/polyamide, 60/40 by weight or 52/48 by volume) tensile properties (denier, tenacity, elongation, modulus) are: 39 denier, 2.2 gpd, 6.3%, 113 gpd. The orientation angle measured by X-ray diffraction is 40. The relatively low tensile properties are attributed to inadequate deaeration.

EXAMPLE 8

A quaternary spin dope consisting of 5.8 weight percent solids (60 weight percent PBT/40 weight percent ABPBI) in 94.2 weight percent solvent (79 weight percent MSA/21 weight percent PPA) was prepared from a solution of ABPBI at 3.0 weight percent concentration in MSA and the same PBT/PPA dope of Example 1. Preparation was as follows: 4.8 grams of ABPBI, poly-2,5(6)-benzimidazole (5.17 intrinsic viscosity) polymer was added to 155.2 grams MSA in a glass jar and stirred at 60° C. using the "Teflon" coated magnetic stirrer. The solution was extremely viscous. The solution was poured into an Atlantic Mixer. Then 48.0 grams of cut up pieces of the PBT/PPA dope were added to the Mixer while operating at slow speed under vacuum (for deaeration) and 50° C. The PBT/PPA dope was found to gradually break up and "dissolve" into the ABPBI/MSA solution. Mixing was continued into the next day. The spin dope was transferred to a spin cell and air-gap spun (0.25 in air-gap) at room temperature at 12.6 meter/minute using a 10-hole spinneret with hole diameter of 0.005 in and a spin-stretch factor of 4.0 indicating that the as-spun yarn could sustain a spin-stretch. The throughput rate was 0.04 ml/min/hole. Due to the presence of many air pockets, the throughput rate was increased to 0.08 ml/min/hole, and yarn was spun at 7.5 meter/minute with a spin-stretch factor of 1.2. To ensure complete removal of the acid solvents, the bobbins of yarn were immersed in water (the extraction solvent) overnight and then air dried. The as-spun filament (PBT/ABPBI, 60/40 by weight or volume) tensile properties (denier, tenacity, elongation, modulus) are: 9.8 g, 6.2 gpd, 10.7%, 272 gpd. The orientation angle for the as-spun fiber is 31°.

EXAMPLE 9

Unidirectional test bars were prepared by winding the PBT/polyamide yarn of Example 1 around a 7 in×7 in×0.25 in plate such that the yarn was laid parallel and 3.5 layers thick. A layer of polyimide film ("Kapton" - E. I. du Pont de Nemours and Co., Inc.) coated with a mold release agent ("Frekote 33") was placed on the plate before and after the yarns were wound. Finally, a thin metal sheet was placed on each side of the structure. This whole assembly was then heated and pressed at 315° C. and 6,000 pounds (122 psi) for 15 minutes. Two (2) coherent films were obtained. 0.25 in×6.0 in strips were cut parallel to the fiber direction and 4.8 g of the strips were stacked inside an open-ended H-shaped female mold. With the male part of the mold and 0.118 in thick shims in place, pressure was applied initially at 300 lbs (200 psi), raised to a maximum of 5,400 lbs (3,600 psi) at 315° C. and released during the cool down period. The resulting bar, 0.25 in×6 in×0.113 in, has a flex strength/modulus of 42 kpsi/9.6 mpsi and short-beam-shear strength of 2.4 kpsi. A thin strip, about 0.78 mm thick, was removed from the bar. It exhibited an orientation angle of 13°.

EXAMPLE 10

A direct winding technique was also used for making unidirectional test bars. The same H-shaped mold was mounted on a rotating shaft and the PBT/polyamide yarn of Example 2 was wound into the open ended female section 0.25 in×6.0 in area on both sides of the mold. After 4.7 grams of yarn was wound, the male section was placed on both sides of the mold and cold pressed at 5,000 pounds to compact the fiber into two bars. The exposed fiber ends at both ends of the mold were cut with a razor blade. Then the mold was opened and the two bars were stacked together and hot pressed in the mold using 0.1195 in shim thickness at 315° C. and 5,000 pounds (3,333 psi) for 20 minutes. An initial cold pressure of only 500 pounds was used, but the pressure was maintained at 6,000 pounds during cool down. Final bar dimensions were 0.1035 in×0.25 in×6 in. Measured flex strength/modulus properties are 54 kpsi/8.8 mpsi with short-beam-shear strength (SBSS) of 4.4 kpsi. A thin strip, about 0.68 mm thick, was removed from the bar. It exhibited an orientation angle of 11°.

By building successive layers of coating on a mold, followed by extraction and drying, an in situ composite of complex shape is easily prepared from the quaternary dopes. A small cylinder was prepared by coating a stainless steel rod with a dope containing 15% solids. Each coating was extracted by washing in water and drying with a hot air gun. After application of four coats, the cylinder was consolidated using a hot air gun at 315°C.

I claim:

1. A fibrid comprising a combination of an intractable polymer selected from poly-p-phenylenebenzobisthiazole, poly-p-phenylenebenzobis-oxazole or poly-2,5-benzoxazole and a thermoplastic polymer in the proportions of 5 to 70 percent by weight of the intractable polymer and 30 to 95 percent by weight of the thermoplastic polymer.

2. A fibrid according to claim 1 wherein the thermoplastic polymer is an amorphous polyamide.

3. A fibrid according to claim 1 wherein the intractable polymer is poly-p-phenylenebenzobisthiazole.

4. A fibrid according to claim 1 wherein the intractable polymer is poly-p-phenylenebenzobisoxazole.

5. A fibrid according to claim 1 wherein the intractable polymer is poly-2,5-benzoxazole.

6. A paper formed from fibrids according to claim 1.

7. A hot-pressed film from the paper of claim 6.

* * * * *